US007509921B2

(12) United States Patent
Dicke

(10) Patent No.: US 7,509,921 B2
(45) Date of Patent: Mar. 31, 2009

(54) FLAG HOLDER FOR WARNING SIGNS

(75) Inventor: Grant D. Dicke, Downers Grove, IL (US)

(73) Assignee: Dicke Tool Company, Downers Grove, IL (US)

( * ) Notice: Subject to any disclaimer, the term of this patent is extended or adjusted under 35 U.S.C. 154(b) by 0 days.

(21) Appl. No.: 11/827,347

(22) Filed: Jul. 11, 2007

(65) Prior Publication Data

US 2009/0013920 A1 Jan. 15, 2009

(51) Int. Cl.
*E01F 9/012* (2006.01)

(52) U.S. Cl. ..... 116/63 P; 116/173; 40/610; 40/612; 248/538

(58) Field of Classification Search ..... 116/63 R, 116/63 P, 63 C, 63 T, 173; 40/606.14, 606.15, 40/606.19, 610, 611.01, 611.02, 611.05, 40/612, 603; 248/514, 538, 223.41, 224.51, 248/224.61, 224.8, 291.1; 403/100–103, 403/396; 404/6, 9, 10
See application file for complete search history.

(56) References Cited

U.S. PATENT DOCUMENTS 1,404,777 A * 1/1922 Leutner ..... 248/512
1,575,614 A * 3/1926 Blaw ..... 248/512
3,357,662 A * 12/1967 Peterson ..... 248/513
4,619,220 A * 10/1986 Seely et al. ..... 116/63 P
4,980,984 A 1/1991 Kulp et al.
5,094,023 A 3/1992 McVey
5,152,091 A 10/1992 Leach
5,197,408 A * 3/1993 Stoudt ..... 116/173
5,231,778 A 8/1993 Belobraydich et al.
5,309,862 A 5/1994 Lang
5,438,782 A * 8/1995 Belobraydich et al. ..... 40/610
5,540,007 A * 7/1996 Kulp et al. ..... 40/610
5,725,186 A 3/1998 Hillstrom et al.
5,829,178 A 11/1998 Hillstrom
5,832,866 A 11/1998 Stoudt
5,895,024 A 4/1999 Williams et al.
6,045,110 A 4/2000 Kulp et al.
6,047,941 A 4/2000 Kulp et al.
6,195,925 B1 3/2001 Werner
6,381,889 B1 5/2002 Knapp
6,427,964 B1 * 8/2002 Hillstrom et al. ..... 248/538

* cited by examiner

*Primary Examiner*—R. A. Smith
*Assistant Examiner*—Amy Cohen Johnson
(74) *Attorney, Agent, or Firm*—Olson & Cepuritis, Ltd.

(57) ABSTRACT

A display system for use with a sign panel includes a bracket with a securement for attachment to a sign panel structure such as a support rib, to receive support therefrom. The bracket includes pairs of diagonally spaced apart support surfaces with each pair of support surfaces defining a channel for receiving a respective flag staff, to support opposite sides of a flag staff at spaced apart locations. A pivot connection pivotally attaches the flag staffs to the bracket, bringing the flag staffs into alignment with the support surfaces as the flags are rotated between an open or display position and a closed or storage position.

28 Claims, 5 Drawing Sheets

FLAG HOLDER FOR WARNING SIGNS

FIELD OF THE INVENTION

The present invention relates to warning signs and in particular to flag indicators used with such signs.

BACKGROUND OF THE INVENTION

Warning signs are employed in a wide variety of different applications. One important application concerns the safety of highway motorists and pedestrians. It is important to alert both motorists and pedestrians that extra care should be exercised at a particular location. Such warnings may arise from conditions which are either temporary or long term. Long term operations are typically accommodated by vehicular barriers, fencing and similar provisions, while temporary situations require special consideration. A temporary situation may arise, for example, when a work crew is dispatched to a location at or immediately adjacent to a roadway. For example, motorists and pedestrians both are accustomed to seeing utility work crews at roadside locations, from time to time. It would not be appropriate, in these instances, to require fencing or other barriers to be erected to provide a warning that extra care should be taken at the immediate location. Rather, lightweight warning systems are employed that are quickly and easily erected and stored from day to day or even within a portion of a workday. Temporary warning signs have been developed for this purpose. For example, a warning legend may be imprinted on a flexible panel having a cloth or other flexible substraight. Such panels may be coated with a reflective material to further improve their ability to warn nearby motorists and pedestrians that they are entering a location requiring that extra care be taken.

Sign stand systems for use with flexible sign panels have been developed. Typically, the flexible sign panel is folded into a roll when its use is temporary suspended. Upon arrival at a worksite, the flexible message panel is unrolled and flattened into a generally planar or sheet-like configuration. A sign stand system is then erected to support the panel in a generally flat or taut condition that is conducive to enhance legibility. While virtually any type of backing support may be provided, it is generally preferred that the sign stand system also be capable of breakdown for storage into a relatively small sized package. It has been found popular in this regard, to provide braces for sign panels that are made of strong, but lightweight materials such as fiberglass ribs. A ground-engaging stand is provided, usually in the form of a ground post or a multi-legged support system that can be folded when not in use. Typically, one of the ribs is arranged in a vertical position and the bottom end of the rib is engaged with the base of the sign stand. In use, the ribs are expanded and engaged with the sign stand base. After unrolling, the sign panel is attached to the ribs preferably in a stretched or taut condition.

As mentioned, warning systems are often times employed adjacent to a roadway, and thus are subjected to buffeting forces arising from motor vehicles passing nearby. Of course, the sign panel also absorbs energy from applied wind loadings. The sign stand base is often times spring loaded to absorb these forces so as to maintain the sign panel relatively immobile.

It has been found important, that despite the proven performance and wide-spread acceptance of light-weight message systems, that additional warning indication be provided. Typically, sign stand systems are designed to maximize the sign panel area that can be reliably supported, despite buffeting from traffic and applied wind loads. Accordingly, it would not be appropriate to enlarge the "sail area" of the message panel with additional devices visible to nearby motorists and pedestrians. One expedient that has been preferred over the years is to affix one or more warning flags to the sign panel system. Flags have the advantage of utilizing applied wind loads and roadside buffeting converting the applied loadings to movement of the supported flags, a strategy that can not be used with the message panel which must be maintained relatively immobile so as to guarantee proper orientation to oncoming motorists and pedestrians.

While flags may be added to the sides of message panels, it is generally preferred that the flags be mounted at the top of the sign stand system so as to extend above the message panel. A variety of flag mounting arrangements have been provided over the years. For example, in U.S. Pat. No. 5,895,024 assigned to the assignee of the present invention, a bracket is provided at the top of a sign panel to support one or more warning flags that extend above the sign panel. When three flags are provided, the central flag is removable from the bracket of the sign panel system, with the remaining flags permanently connected to the bracket for pivoting between display and storage positions. U.S. Pat. Nos. 5,725,186 and 6,381,889 provide brackets with individual positions for multiple flags.

Several patents provide arrangements in which one or more flag staffs are permanently secured to a sign panel system. The following patents provide permanent pivotal attachments for flags selectably movable from an upright display position to a storage position, where the flag staffs are aligned with a vertical sign panel rib, in preparation for rollup and storage. Included are U.S. Pat. Nos. 4,980,984; 6,045,110; 6,047,941; 5,829,178; 5,832,866; and 5,829,178. U.S. Pat. No. 5,152,091 provides a bracket at the top of a sign stand assembly to which flag staffs are permanently pivotally mounted for rotation parallel to the message panel. Arms project outwardly from the bracket in a direction generally perpendicular to the plane of the message panel to provide stops for the flag staffs, preventing their unintentional collapse, once erected in an upright position at acute angles to the vertical. Problems have been observed with this latter type of arrangement. As mentioned, the sign panel system and any warning flags attached thereto are subjected to buffeting from nearby traffic as well as wind loading. These forces are also applied to the warning flags and these forces can be considerable, especially when energetic wind gusts repeatedly pound against the warning flags and their flag staffs. With repeated loading and vibration due to wind forces, the arms, which normally provide position stops for the flag staffs, have been observed to wear away at the flag staff edges, causing premature deterioration of the flag staffs, and hence requiring accelerated maintenance.

Despite the advances made in the field of flag displays and other types of warning devices associated with highway warning systems, further advantages in cost and manufacture are still being sought.

SUMMARY OF THE INVENTION

A sign stand system embodying the present invention includes a sign stand base having ground engaging legs supporting an upright mast which in turn supports a flexible sign panel. A cross brace is attached to the mast and extends in a generally horizontal direction so as to support opposed horizontal corners of the sign panel. If desired, the a vertical brace can be provided to directly support top and bottom corners of the sign panel with a mast in turn supporting the vertical brace. A clamp is secured at the top of the sign stand system, and is secured either to the vertical brace or the upright mast.

Preferably, the bracket is located adjacent the upper portion of the sign panel and if desired, could be mounted above the sign panel. The bracket includes four spaced-apart body portions disposed in pairs, one pair above the other. The body portions are spaced apart so as to define at least two channels for receiving a flag-supporting staff. Preferably, the flag-supporting staff is pivotally attached to a portion of the bracket centrally located with respect to the body portions. When the flags are deployed, the flag staffs are rotated for alignment with a respective channel, with two of the body portions being longitudinally spaced apart with respect to the longitudinal axis of the staff, and simultaneously engaging opposed sides of the staff. The body portions cooperate with the pivotal connection to support and lock the flag staffs in predetermined positions.

These and other advantages and features of the present invention which will become apparent from setting the appended description drawings and claims are attained in a display system provided for use with a sign panel, for mounting at least two flags that are supported by respective flag staffs. Included is a bracket which preferably has a monolithic construction, provided with a securement such as a passageway for a bolt to attach the bracket to a structure associated with the sign panel. In one example, the structure is a vertical support member preferably in the form of a vertical rib. The bracket includes four spaced-apart body portions arranged in pairs, the body portions of each pair preferably being diagonally spaced apart one from the other. Preferably, the four body portions comprise surfaces of raised body parts preferably having a triangular shape and arranged so as to form two diagonal channels.

A pivot connection is provided for attaching the flag staffs to a portion of the bracket, preferably a portion located between the body parts, so that the flag staffs may be rotated into and out of alignment with the channels. When rotated into alignment with the respective channels, the flag staffs are fixed in a preselected rotational position, with the pairs of body portions supporting respective flag staffs. The support points for each flag staff are longitudinally spaced apart from one another along the longitudinal axis of the flag staff and positioned so as to simultaneously engage oppose the sides of the flag staff. In one arrangement, the pivot connection comprises a bolt or the like fastener extending through the flag staffs and the bracket for attachment to a supporting member such as a vertical rib support of a sign panel. On the side of the bracket facing away from the body portions, a raised mounting pad is provided for clearance from the vertical rib.

In one arrangement, the body parts, comprising three-sided generally triangular-shaped components have corners laterally opposed to one another with the pivot connection disposed between the opposed corners. If desired, a vertical recess may be formed in the bracket, extending through the pivot connection so as to receive a flag staff of a third flag member. The body parts are spaced apart one from the other so as to form a vertical channel and the flag staffs are pivotable to an inverted vertical storage position, with the flags located below the pivot connection.

In another example a warning sign system is provided for displaying information. A warning sign system includes, in addition to the display system described above, a sign panel and a vertical support member, such as a rib, for supporting the sign panel and the bracket. Preferably, the bracket is located adjacent an upper portion of the vertical rib so that the flags, when rotated to a display position, extend above the sign panel.

DETAILED DESCRIPTION OF PREFERRED EMBODIMENTS

Figure 1:
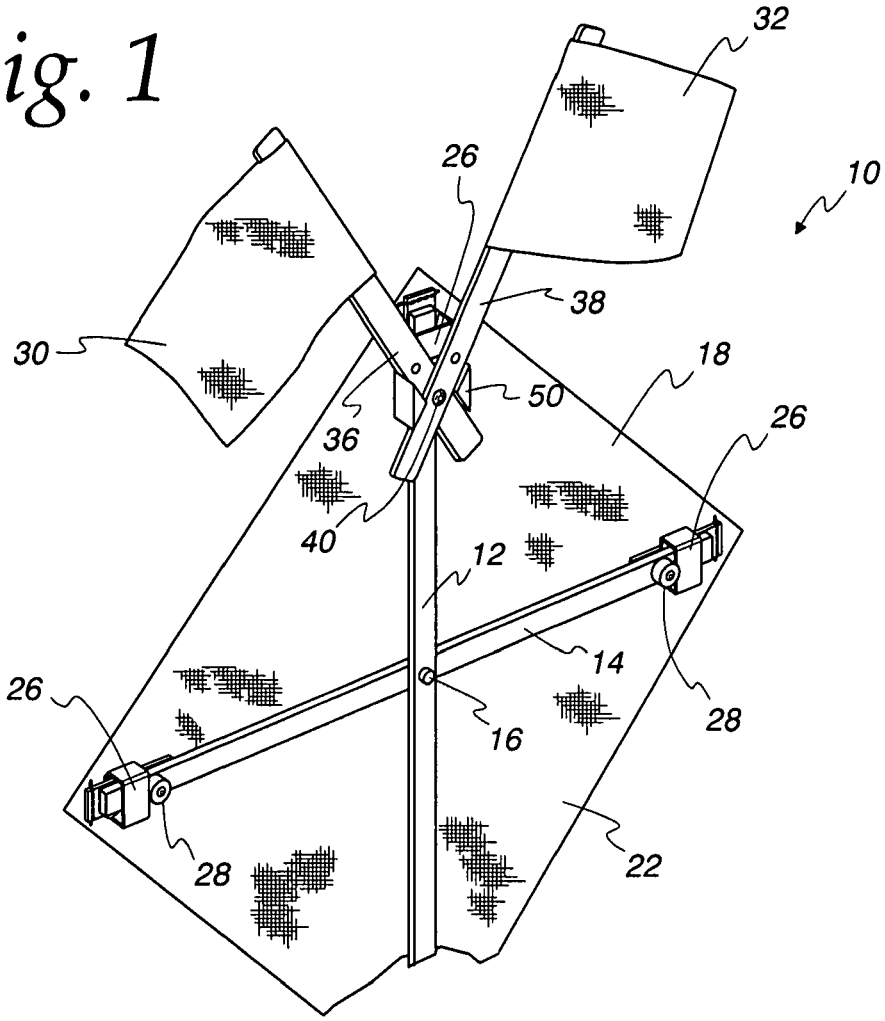
FIG. 1 is a fragmentary view of a warning sign system according to principles of the present invention.

The invention disclosed herein is, of course, susceptible of embodiment in many different forms. Shown in the drawings and described herein below in detail is a preferred embodiment of the warning sign system of the invention. It is to be understood, however, that the present disclosure is an exemplification of the principles of the invention and does not limit the invention to the illustrated embodiment.

For ease of description, warning sign systems utilizing a bracket embodying the present invention is described herein below in its usual assembled position as shown in the accompanying drawings, and terms such as upper, lower, horizontal, longitudinal, etc., may be used herein with reference to this usual position. However, the warning sign systems may be manufactured, transported, sold, or used in orientations other than and described and shown herein.

Referring now to the drawings, and initially to FIGS. 1 and 7-9, a warning sign system generally indicated at 10 includes a sign panel 12, preferably made of flexible material, supported at its corners by a vertical support member or rib 12 pivotally connected at 16 to a horizontal support member or rib 14. Sign panel 12 has a front face 20 visible in FIG. 7 and a rear face 22 visible in FIGS. 1, 8 and 9. Referring again to FIG. 1, sign panel attachments 26 are mounted to the sign panel and cooperate with rib stops 28 and with bracket 50 to maintain the panel in a stretched or taught position. Ribs 12, 14 can be deflected for disengagement from panel attachments 26 allowing the ribs to be rotated at 16 so as to overlie one another for compact packaging. The sign panel, made of flexible material, may be rolled about the folded ribs for storage. As will be seen herein, the flags 30, 32 may be moved from an open or display position, illustrated for example in FIGS. 1 and 7, to a folded position illustrated in FIG. 9 for storage along with the remainder of the display system.

Figure 9:
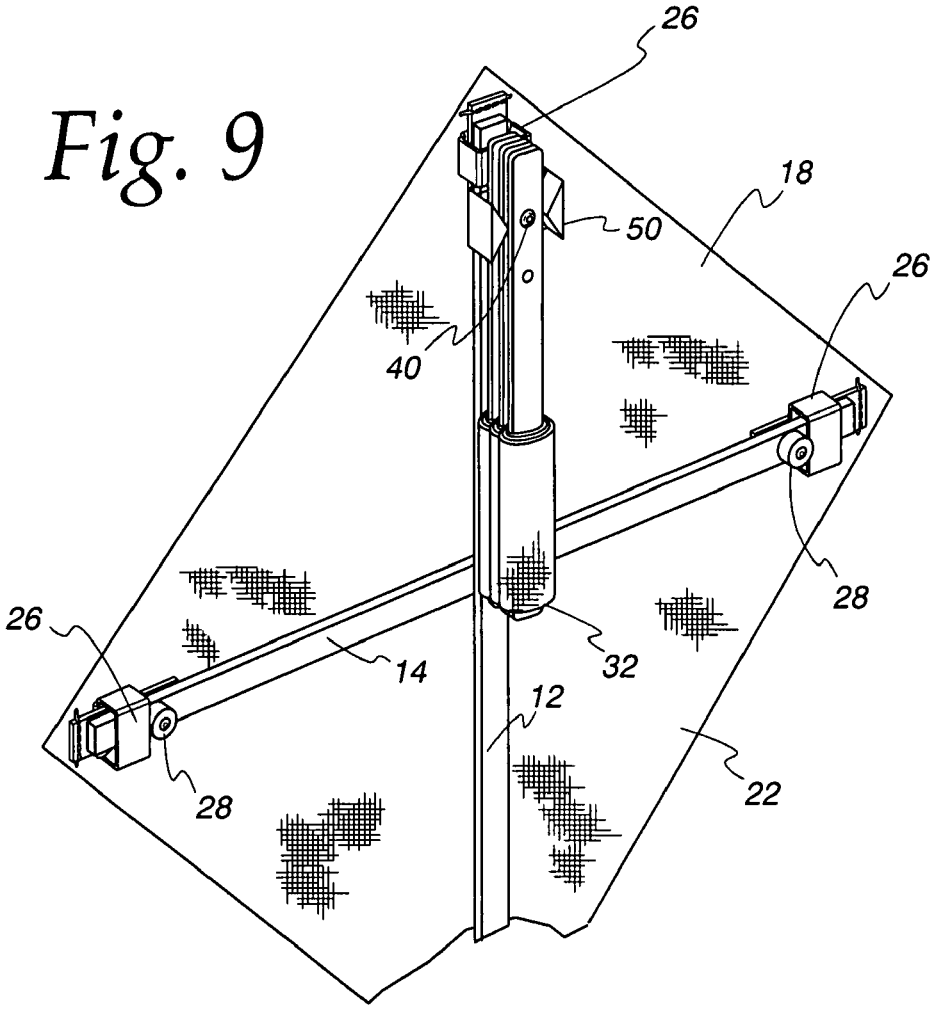
FIG. 9 is a fragmentary perspective view thereof, with the flag staffs rotated to a storage position.

Referring again to FIG. 1, flags 30, 32 are supported by flag staffs 36, 38 respectively and are pinned at 40 to be upper end of rib 12. As can be seen in FIGS. 1 and 9, for example, pin 40 also extends through a bracket 50 so that the bracket supports movements of the flag staffs 37, 38 and hence the flags 30, 32.

Figure 2:
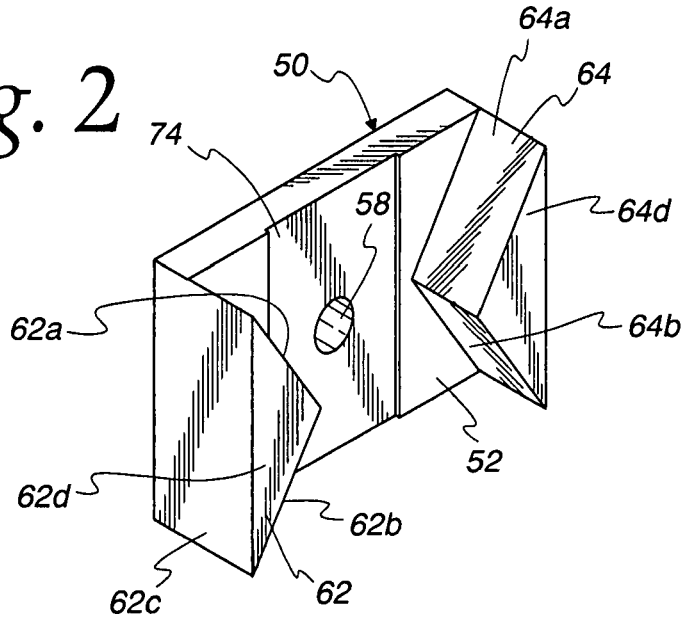
FIG. 2 is a perspective view of a bracket thereof.
Figure 3:
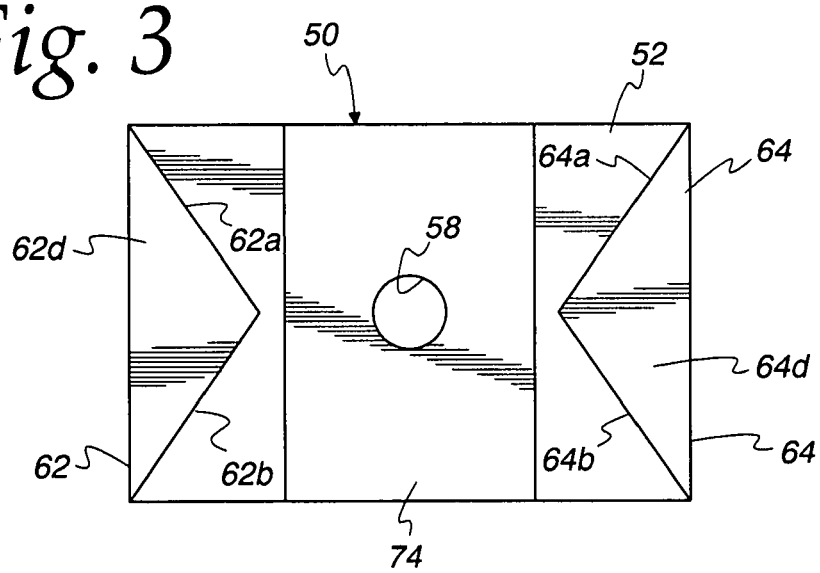
FIG. 3 is a front elevational view thereof.
Figure 4:
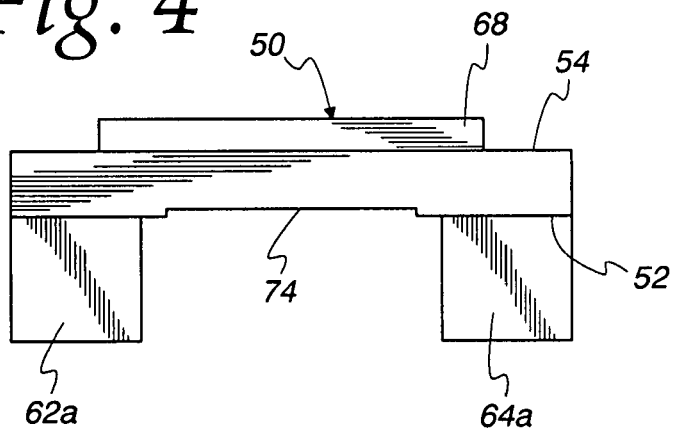
FIG. 4 is a top elevational view thereof, the bottom elevational view being identical.
Figure 5:
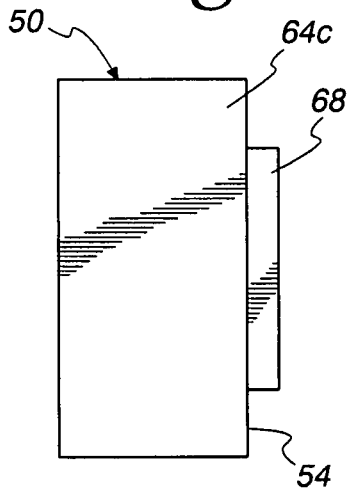
FIG. 5 is a side elevational view thereof with a view from the opposite side being identical.
Figure 6:
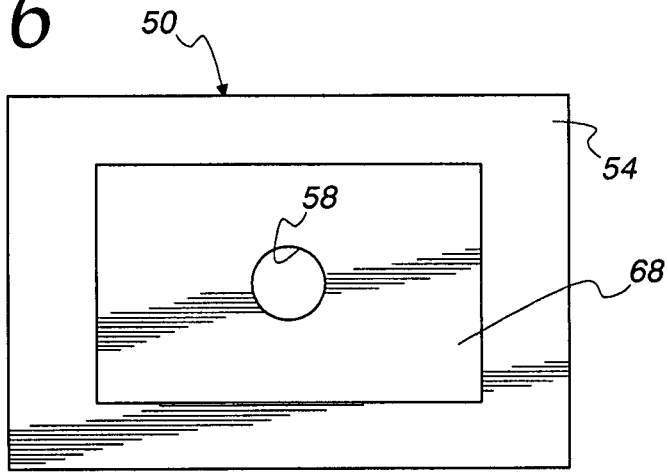
FIG. 6 is a rear elevational view thereof.

Turning now to FIGS. 2-6, bracket 50 is shown in greater detail. Bracket 50 preferably is formed with a monolithic one-piece body made of suitable material, such as plastics, using conventional techniques such as molding or the like. As can be seen in FIGS. 2 and 3, for example, bracket 50 has a forward facing major surface 52 and as can be seen in FIG. 6, a rearward facing major surface 54. A hole or passageway 58 extends through the body of bracket 50, between front and rear major surfaces 52, 54. Passageway 50 is preferably centrally located with respect to the bracket body, and receives pin 40 which secures the bracket, along with the flag staffs 36, 38 to rib 12. If desired, pin 40 can be attached to a different securement member such a vertical support extending alongside rib 12.

As can be seen in FIGS. 2 and 3, a pair of laterally opposed side portions 62 are located on either side of passageway 58 so as to protrude from major surface 52. Side portions 62, 64 have upper working surfaces 62*a*, 64*a*, and lower working surfaces 62*b*, 64*b*, respectively. Rear surfaces of 62*c*, 64*c* are preferably coextensive with the edge surfaces of the remainder of the bracket body. As can be seen in FIGS. 4-6, a slab-like standoff 68 protrudes outwardly from rear surface 54. The exposed surface of standoff 68 contacts the surface of vertical rib 12 and, in one embodiment, pivots relative to rib 12 to move the flags and flag staffs from an upright or display position shown in FIGS. 1 and 7, to the inverted or storage position illustrated in FIG. 9. Alternatively, bracket 50 can be permanently and fixedly secured to rib 12. Rotation of the flag staffs 36, 38 with respect to bracket 50, can be seen by comparing FIGS. 1 and 9. However, fixing the bracket in position is not preferred, since pin 40 must be extended to allow bending of the flag staffs 36, 38 so as to clear the triangular front faces 62*d*, 64*d*, visible for example in FIGS. 2 and 3.

As can be seen for example in FIGS. 2 and 3, the upper and lower surfaces 62*a*, 64*b* and 64*a*, 64*b* meet at the edges formed at the tips of the triangular faces 62*d*, 64*d*. With reference to FIG. 3, it is generally preferred the diagonally opposed surfaces 62*a*, 64*b* are preferably offset and generally parallel to one another, as are the remaining pair of diagonal surfaces 64*a*, 62*b*. As will be seen herein, the flag staffs 36, 38 are supported by diagonally opposed surface pairs which cooperate to form channels for receiving the flag staffs in a defined position. For example, flag staff 36 simultaneously contacts and receives support from diagonally opposed surfaces 62*a*, 64*b*. It is generally preferred that such contact is continuous throughout the surfaces 62*a*, 64*b* such that the largest surface area contact between the flag staffs and the support surfaces is maintained automatically as flag staff 36 is pivoted about pin 40 and hole 58 so as to extend in a downward direction in which gravity maintains the desired contact. In a similar manner, opposed sides or edges of flag staff 38 simultaneously contact and engage diagonally opposed surfaces 64*a*, 62*b*. As can be seen for example in FIG. 4, the support surfaces 62*a*, 64*a* are continuous and generally coplanar throughout their entire extent. However, as will be appreciated, only a portion of the support surfaces is required for the desired contact with a particular flag staff. If desired, the remaining unused portions of these surfaces can be relieved or otherwise removed, although it has been found expedient to form the entire support surfaces as a single continuous surface, as shown in the figures.

Figure 7:
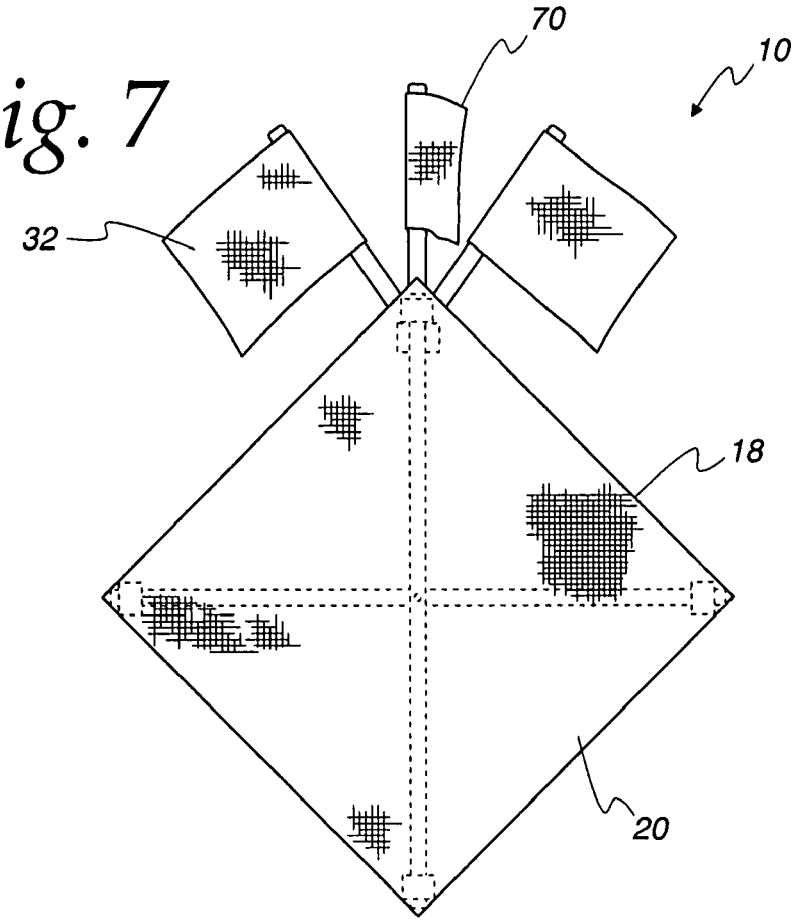
FIG. 7 is a front elevational view of the warning sign system of FIG. 1.
Figure 8:
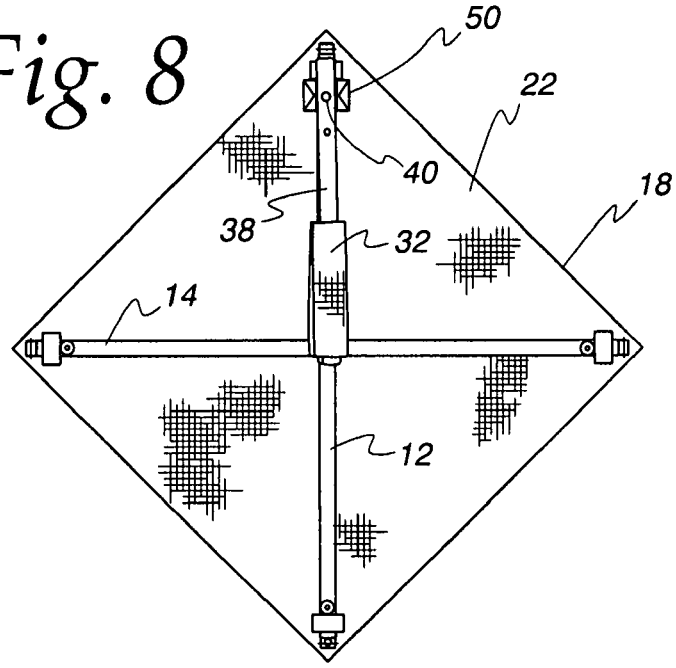
FIG. 8 is a rear elevational view thereof.

FIGS. 7 and 9 show an optional arrangement which includes a third, generally upright or vertical flag 70 supported by its own flag staff (not numbered). Bracket 50, without modification, can be employed to accommodate two-flag arrangements as shown in FIG. 1, for example, as well as three-flag arrangements shown for example in FIG. 7. When a third flag used installed, it is preferably the first flag inserted against the bracket body. Although not required, it has been found convenient to provide a vertical depression or recess 74, dimension for a close tolerance fit with the flag staff supporting flag 70. In this manner, the flag staff supporting central flag 70 is rotationally fixed to bracket 50 whereas the flag staffs of the remaining flags are free to rotate between the display position illustrated in FIG. 1 and the storage position illustrated in FIG. 9. As mentioned above, the rear surface of bracket 50 preferably includes an optional pad-like standoff 68, visible in FIGS. 4-6. Pads 68, when provided, gives clearance between the forward most flag staff and any nearby obstructions, such as the panel securement 26 shown at the upper most or 12 o'clock position in FIG. 9. With standoff 68, when bracket 50 is rotated between the upright or displayed position and the roundedly extending storage position, the flag staffs are able to clear the panel securement located at the top of the sign panel.

Figure 10:
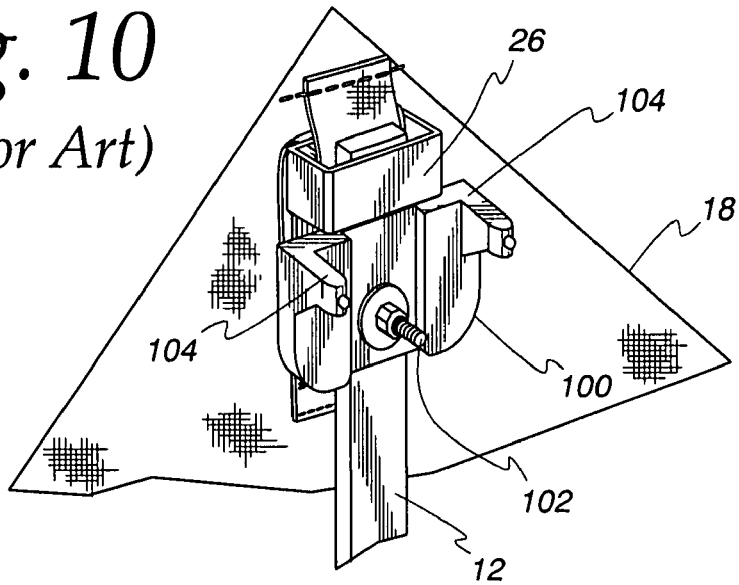
Fig. 10 (Prior Art)
FIG. 10 is a fragmentary perspective view of a prior art display system.
Figure 11:
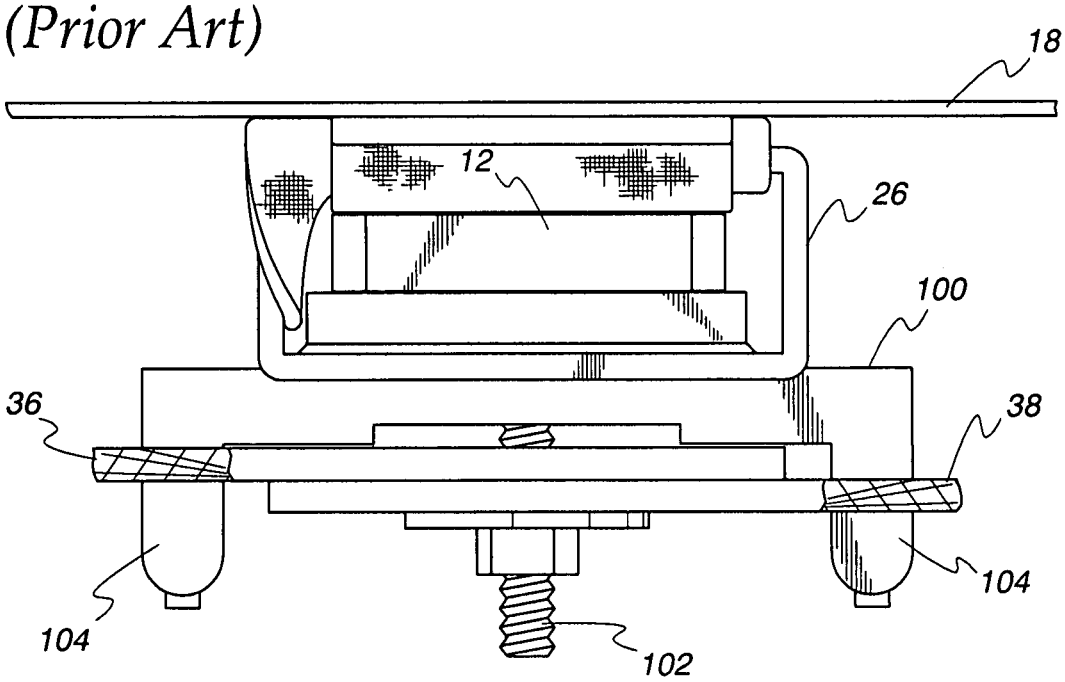
Fig. 11 (Prior Art)
FIG. 11 is a top elevational view thereof.
Figure 12:
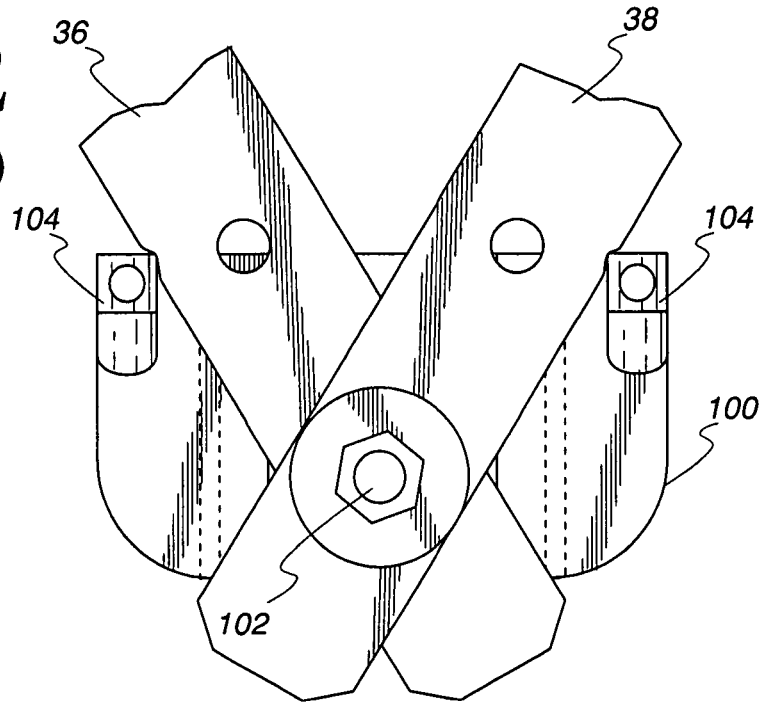
Fig. 12 (Prior Art)
FIG. 12 is a fragmentary front elevational view thereof, shown with flag staffs installed.

FIGS. 10-12 show a prior art arrangement in which a bracket 100 is provided with a central pivot connection 102 and a pair of stops or rotation limiting arms 104. As can be seen in FIGS. 10 and 12, for example, arms 104 have sharp right-angled corners against which the flag staffs 36, 38 make contact. As indicated in FIG. 12, this contact causes corners of the arms 104 to be driven into the edges of flags staffs 36, 38 causing the flag staffs to become dented at the point of contact. This denting is more than superficial cosmetic blemish. Although the ribs and flag staffs of the sign system could be made of aluminum or other homogenous, monolithic material, they are preferably formed from fiberglass materials which typically include bundles of longitudinally extending strands encased in a hardened resin medium. Denting, such as that shown in FIG. 12 causes a number of fiberglass strands to work free from the hardened resin matrix and, with eater infiltration as well as freeze/thaw cycles, cause inevitable spread of the breakdown of the fiberglass matrix, requiring the flag staffs and usually attached flags, to be discarded. It has been found that denting is inevitable due to the line contact between the corners of arms 104 and the edges of the flag staffs, as the flag staffs are repeatedly stored and displayed, as required. Further deterioration results from the effect of wind loadings and the like which catch the flags, driving the flag staffs harder against the corners of arms 104. With the claimed invention, the area of contact between the support bracket 50 and the flag staffs is greatly enlarge to encompass the full extent of the surfaces 64*a*, 64*b*, 62*a* and 62*b*.

Several variations are possible, without requiring substantial increase in manufacturing or assembly cost. For example, a greatly enlarged contact surfaces 62*a*, 62*b*, 64*a* and 64*b* have been found sufficient to prevent damage to the flag staffs, even when the bracket is made of relatively hard plastic, aluminum or the like material. It is also possible to form bracket 50 from elastomeric or other resilient materials such as rubber. Alternatively, a rubber face can be conveniently applied to the contact surfaces by use of adhesive, by insets or inserts of elastomeric material into the contact surfaces or by forming elastomeric inserts which are slotted, keyed, or otherwise configured for sliding engagement with the side portions 62, 64. Alternatively, the entire side portions 62, 64 could be formed of elastomeric material which is applied to the major face of bracket 50. As a further alternative, side portions 62, 64 could be replaced by pairs of pins, posts or other conveniently shaped stop members formed of elastomeric material or a rigid base having an outer elastomeric covering. The stop members, having at least an outer surface of elastomeric material, could have a contact area considerably smaller than the area of contact surfaces 62*a*, 62*b*, 64*a* and 64*b*.

The foregoing descriptions and the accompanying drawings are illustrative of the present invention. Still other variations and arrangements of parts are possible without departing from the spirit and scope of this invention.

What is claimed is:

1. A display system for use with a sign panel, for mounting at least two flags supported by respective flag staffs, to a structure, comprising:

a bracket with at least one pivotal securement for attachment to the structure so as to be pivotable with respect to the structure, between a display position and a storage position;

the bracket including four spaced-apart body portions disposed in pairs;

with respect to each pair of body portions, one body portion disposed above the other so that the body portions of the bracket define at least two channels, each for receiving a respective flag staff;

the at least one pivotal securement pivotally attaching the flag staffs to a portion of the bracket so that the flag staffs may be rotated with respect to the bracket, between a display position and a storage position that is out of alignment with the channels and with the flag staffs substantively overlying one another;

when rotated to the display position, the flag staffs aligned with respective channels, with the flag staffs being fixed in a preselected rotational position, with the pairs of body portions supporting respective flag staffs being longitudinally spaced apart with respect to the longitudinal axis of their respective flag staff, and simultaneously engaging opposed sides of the flag staff.

2. The display system according to claim 1 wherein the channels are inclined to the vertical.

3. The display system according to claim 2 wherein the channels intersect one another.

4. The display system according to claim 1 wherein the bracket has a monolithic body that includes the four body portions.

5. The display system according to claim 4 wherein the body portions comprise inclined surfaces of raised body parts.

6. The display system according to claim 5 wherein the body parts are three-sided, with two sides comprising two of the body portions.

7. The display system according to claim 6 wherein the body parts are laterally opposed and laterally spaced from one another.

8. The display system according to claim 5 wherein the body parts include corners that are laterally opposed to one another.

9. The display system according to claim 8 wherein the pivot connection is located between the corners.

10. The display system according to claim 4 wherein the bracket has a standoff adjacent the pivotal securement.

11. The display system according to claim 1 wherein the bracket defines a vertical recess for receiving a third flag staff.

12. The display system according to claim 1 wherein the bracket defines a vertical passageway, and the flag staffs are pivotable into substantial alignment with the vertical passageway.

13. The display system according to claim 1 wherein the pivot connection is located adjacent ends of the flag staffs that comprise bottom ends when the staffs are pivoted to move the flags to a display position.

14. The display system according to claim 13 wherein the flag staffs are pivotable for vertical inversion to the storage position with the flags located below the at least one pivotal securement.

15. The display system according to claim 1 wherein the body has opposed major surfaces with the body portions extending from one major surface and a raised mounting standoff extending from the other major surface.

16. A warning sign system for displaying information, comprising:

a sign panel;

a vertical support member for supporting the sign panel;

at least two flags supported by respective flag staffs;

a bracket with at least one pivotal securement for attachment to the vertical support member so as to be pivotable with respect to the vertical support member, between a display position and a storage position;

the bracket including four spaced-apart body portions disposed in pairs;

with respect to each pair, one body portion disposed above the other so that the body portions of the bracket define at least two channels, each for receiving a respective flag staff;

the at least one pivotal securement pivotally attaching the flag staffs to a portion of the bracket so that the flag staffs may be rotated with respect to the bracket, between a display position and a storage position that is out of alignment with the channels and with the flag staffs overlying one another; and when rotated to the display position, the flag staffs aligned with respective channels, with the flag staffs being fixed in a preselected rotational position, with the pairs of body portions supporting respective flag staffs being longitudinally spaced apart with respect to the longitudinal axis of their respective flag staff, and simultaneously engaging opposed sides of the flag staff.

17. The warning sign system according to claim 16 wherein the body portions comprise inclined surfaces of raised body parts.

18. The warning sign system according to claim 16 wherein the body portions are three-sided, with two sides comprising two of the body portions.

19. The warning sign system according to claim 18 wherein the body-parts include corners that are laterally opposed to one another and the pivot connection is located between the corners.

20. The warning sign system according to claim 19 wherein the bracket defines a vertical passageway, the flag staffs are pivotable into alignment with the vertical passageway and the at least one pivotal securement is located adjacent ends of the flag staffs that comprise bottom ends when the staffs are pivoted to move the flags to a display position.

21. The display system according to claim 16 wherein the bracket has a standoff adjacent the pivotal securement.

22. A display system for use with a sign panel, for mounting at least three flags supported by respective flag staffs, to a structure, comprising:

a bracket with at least one pivotal securement for attachment to the structure with pivotal movement between a display position and a storage position;

the bracket including a central recess for receiving a first flag staff and further including four spaced-apart body portions disposed in pairs;

with respect to each pair of body portions, one body portion disposed above the other so that the body portions of the bracket define at least two channels, for receiving a second and a third flag staff;

the at least one pivotal securement pivotally attaching the second and the third flag staffs to a portion of the bracket so that the second and the third flag staffs may be rotated with respect to the bracket, between a display position and a storage position out of alignment with the channels and overlying the first flag staff;

when rotated to the display position, the second and the third flag staffs aligned with respective channels, with the second and the third flag staffs being fixed in a preselected rotational position, with the pairs of body portions supporting respective flag staffs being longitudinally spaced apart with respect to the longitudinal axis of their respective flag staff, and simultaneously engaging opposed sides of the flag staff.

23. The display system according to claim 22 wherein the bracket has a monolithic body that includes the four body portions.

24. The display system according to claim 23 wherein the body portions comprise inclined surfaces of raised body parts.

25. The display system according to claim 24 wherein the body parts are three-sided, with two sides comprising two of the body portions.

26. The display system according to claim 25 wherein the body portions are laterally opposed and laterally spaced from one another.

27. The display system according to claim 23 wherein the bracket has a standoff adjacent the pivotal securement.

28. The display system according to claim 22 wherein the body portions include corners that are laterally opposed to one another.

* * * * *